United States Patent [19]

Wojcik et al.

[11] 4,022,678

[45] May 10, 1977

[54] ELECTROLYTIC CELL

[76] Inventors: Bruce C. Wojcik, 350 Blue Lakes Blvd. North, Twin Falls, Idaho 83301; Wilfred H. Herrett, Box Z, Filer, Idaho 83328; Gerald D. Cooper, Rte. No. 2 North, Box 106, Pocatello, Idaho 83201; Reed Goold, Rte. No. 4, Twin Falls, Idaho 83301; Charles W. Wojcik, 1004 Delmar Drive, Twin Falls, Idaho 83301

[22] Filed: Apr. 14, 1975

[21] Appl. No.: 567,949

[52] U.S. Cl. ..... 204/273; 204/105 R; 204/222; 204/232; 204/234; 204/261

[51] Int. Cl.[2] ..... C25C 1/00; C25C 7/00

[58] Field of Search ..... 204/105 R, 106, 109, 204/222, 232, 234, 237, 261, 273, 275, 286

[56] References Cited

UNITED STATES PATENTS

| | | | |
|---|---|---|---|
| 808,798 | 1/1906 | Wood et al. | 204/273 |
| 844,263 | 2/1907 | Dieterich | 204/275 X |
| 1,279,860 | 9/1918 | Greenwalt | 204/273 X |
| 1,362,082 | 12/1920 | Cowper-Coles | 204/273 X |
| 1,379,089 | 5/1921 | Edison | 204/273 X |
| 1,892,413 | 12/1932 | Teats et al. | 204/286 |
| 3,558,455 | 1/1971 | Sorensen et al. | 204/105 R |

*Primary Examiner*—Arthur C. Prescott
*Attorney, Agent, or Firm*—K. S. Cornaby

[57] ABSTRACT

An electrolytic cell comprising a rectangular tank divided into a plurality of adjacent compartments by a plurality of spaced apart parallel electrode plates. The outboard electrodes may form one pair of the opposite tank walls. Alternate electrodes are of opposite polarity. The intermediate electrodes terminate short of the tank ends so that the slurry or solution may pass around both ends of the electrode. An agitator is mounted in each compartment. The agitators are shaped and positioned to direct a predetermined volume of slurry against each electrode, the amount being directed against the cathode and anode respectively may be equal or unequal depending on the metal being recovered and the chemical reaction required at the electrode. Strips of non-conductive material are arranged in the cell in spaced overlapping relationship with the peripheral side and bottom edges of each side of each cathode thereby blocking straight line current flow between the cathode edges and the closest anode area while defining a narrowed passage for directing slurry past such edges in a scrubbing action. The agitators and the associated mounting means can be adjusted to vary the volume of flow against the electrodes. Lifting fins are provided on the agitators for maintaining solids in suspension. An inlet and outlet are provided on opposite sides of the tank and the spaces around the ends of the intermediate electrodes and between the cathodes and the non-conductive strips are selected so that reciprocation of the agitators enhances flow of slurry through successive chambers between the inlet and outlet.

9 Claims, 10 Drawing Figures

ELECTROLYTIC CELL

BACKGROUND OF THE INVENTION

Electrolytic recovery of metal from solutions and slurries is known. It has enjoyed considerable success in the electrowinning or refining of metals from clear solutions and moderate success in the direct electrowinning of metals from slurries of ores and concentrates.

A cell that has proven especially useful in the electrowinning of metals, particularly copper and silver, directly from slurries of ore or concentrates thereof is one of recent development in which a cathode is reciprocated between spaced anodes, the slurry is highly agitated and current densities of as high as 75–100 amps/ft$^2$ of cathode area are employed to recover plates of high grade metal at high efficiencies.

Although the foregoing cell has been successful in electrowinning of metal, it suffers from certain drawbacks that adversely affect its efficiency and cost. For instance, stopping and starting of the cathode during oscillation frequently causes premature shedding of product plates from the cathode. This necessitates frequent shutdown for plate removal; and is a particular disadvantage in cells with large cathodes. Also, in such a cell, it is not possible to control the relative quantities of slurry flowed agains the anode and cathode respectively which means that there must be sufficient electrode (particularly anode) area to satisfy all system needs. If reaction conditions promote low efficiency then it is necessary to provide more anode area to compensate. found that by exercising control of the relative volume of slurry flowed against the electrodes, we can maximize their efficiency thus avoiding the need for excess electrode area. Illustratively, electrowinning with the use of an electrolyte having a high ferric iron content and at high current densities has been demonstrated as a viable process. However, such process, when employed in prior art cells, suffers from the disadvantage that anode leaching is inefficient thus requiring that the anode area be several times the cathode area. This requires larger cells thus increasing initial cost and expense of operation. Moreover, even in the above-mentioned reciprocating cathode cell, high current densities (above 100 amp/ft$^2$) often result in an excessive buildup of dendritic copper adjacent the end and bottom edges of the cathode as well as polarization which causes burned or powdery plates, both of which detract from plate quality.

FIELD AND SUMMARY OF THE INVENTION

This invention relates to improved ways and means for direct electrowinning of metal from slurries containing solid forms thereof.

The invention is particularly directed to a cell in which reciprocation of heavy electrodes is eliminated, cathode edges are protected against dendrite formation, and powder formation is eliminated. Means are provided to control the volume of slurry directed against the anode and cathode respectively thereby to adjust electrode efficiency to selected operating conditions. And means are also provided to aid in moving the slurry through the cell.

It is the primary object of this invention to provide an electrolytic cell having a plurality of internal fixed electrodes with agitation means therebetween to maintain slurry in suspension and to direct controlled volumes thereof against the electrodes in a scrubbing action.

A further object is the provision, in such a cell, of means for selectively proportioning the flow of slurry against the anode and cathode respectively in response to the requirements of the ore being treated. This enables the cell to take maximum advantage of the reactions occurring at the electrodes so that the ratio of anode area to cathode area may be substantially at unity yet the cell is adapted to treat a variety of ores each requiring different conditions of operation.

Still another object is to provide, in a cell of the type described, means for blocking formation of dendritic metals at the edges of the cathode.

BRIEF DESCRIPTION OF THE DRAWINGS

In order that the invention may be more readily understood and carried into effect, reference is made to the accompanying drawings and the description thereof which are offered by way of illustration only and not in limitation of the invention, the scope of which is defined by the appended claims and equivalents thereof.

Figure 1:
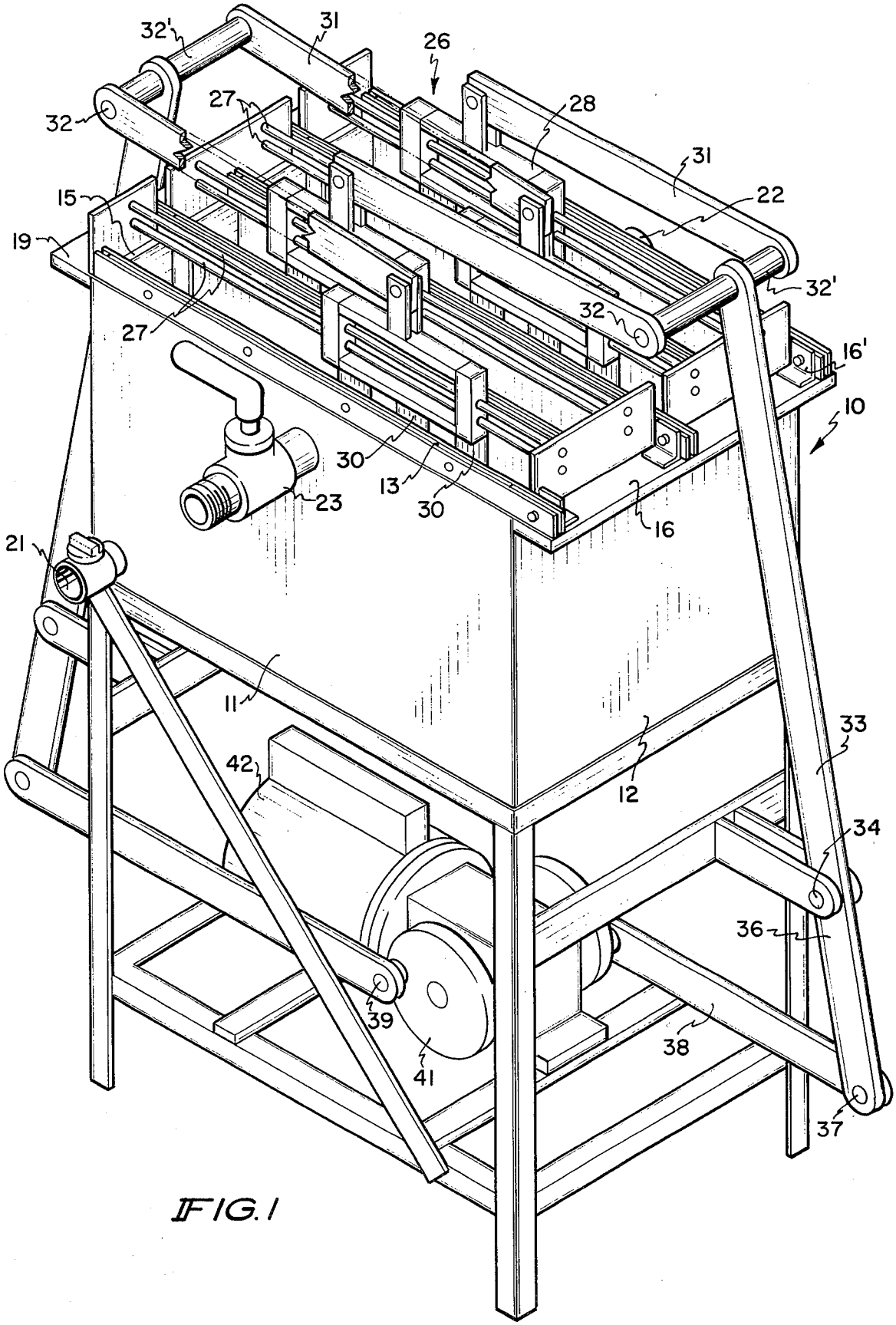

IN THE DRAWINGS:

FIG. 1 is an isometric view of a cell embodying the invention.

Figure 2:
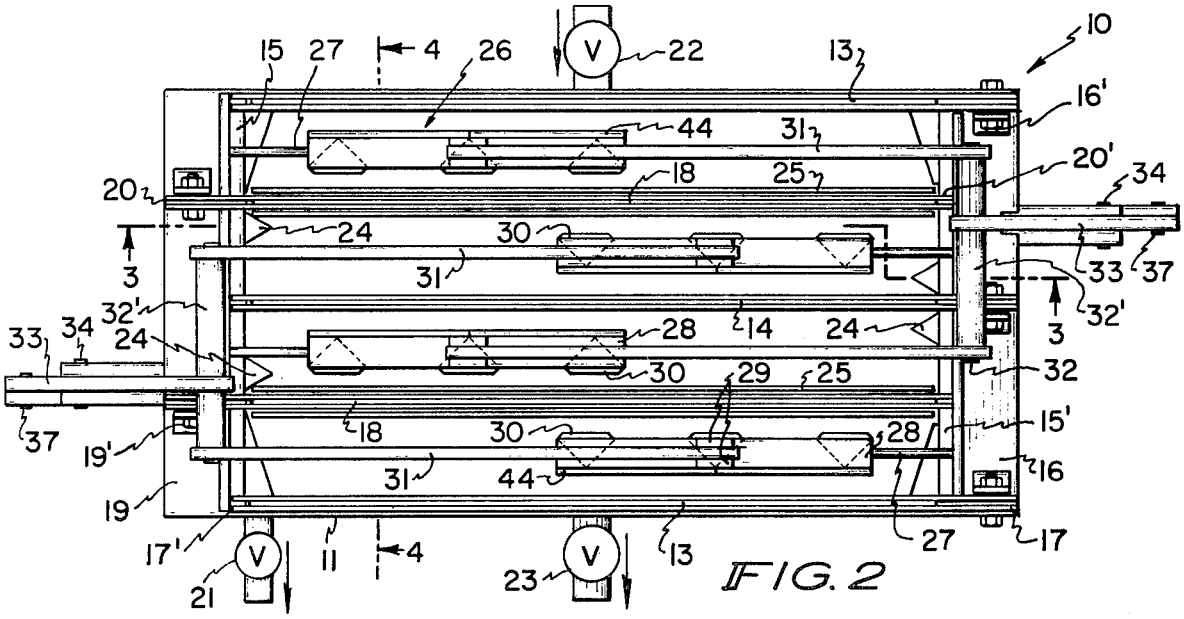

FIG. 2 is a view looking into the top of the cell illustrated in FIG. 1.

Figure 3:
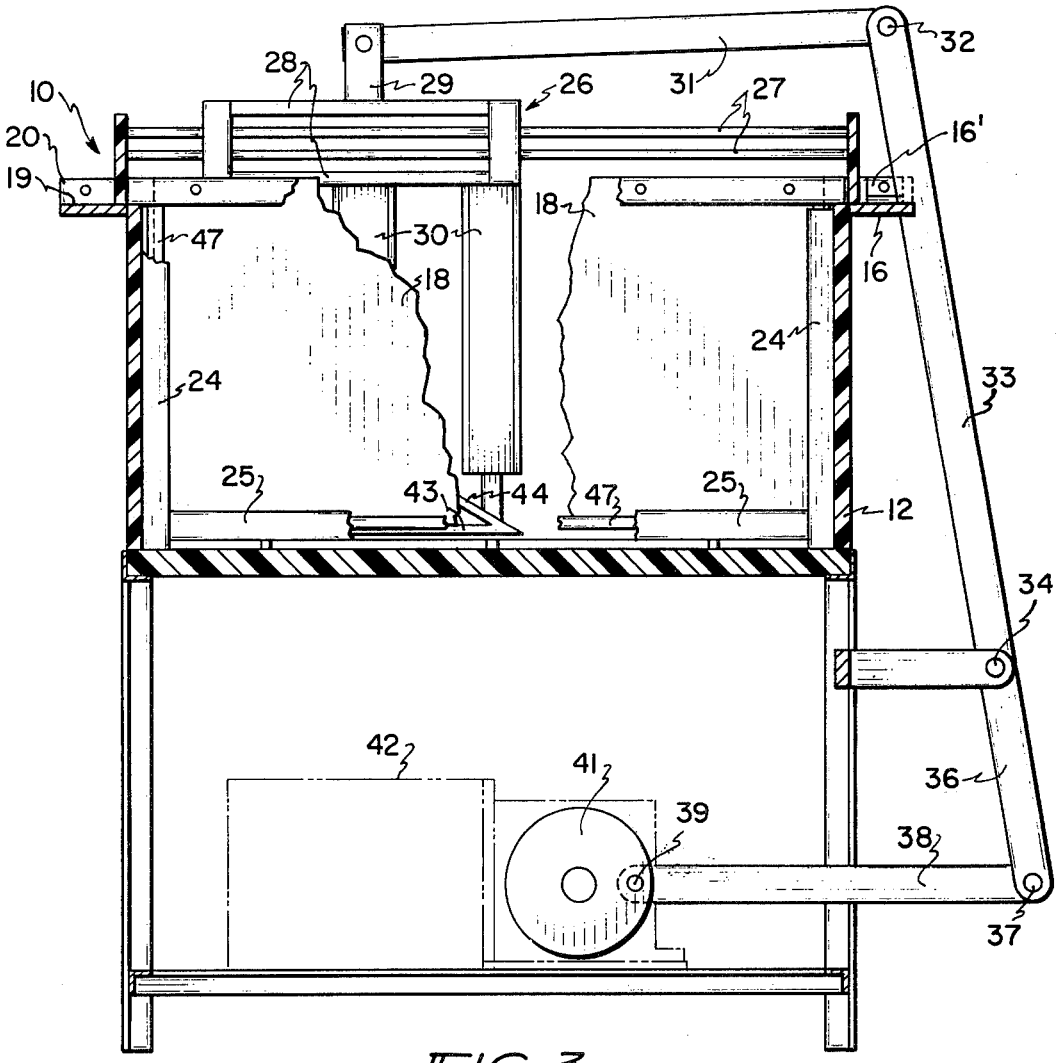

FIG. 3 is a sectional view taken in the plane of line 3—3 of FIG. 2 and looking in the direction of the arrows.

Figure 4:
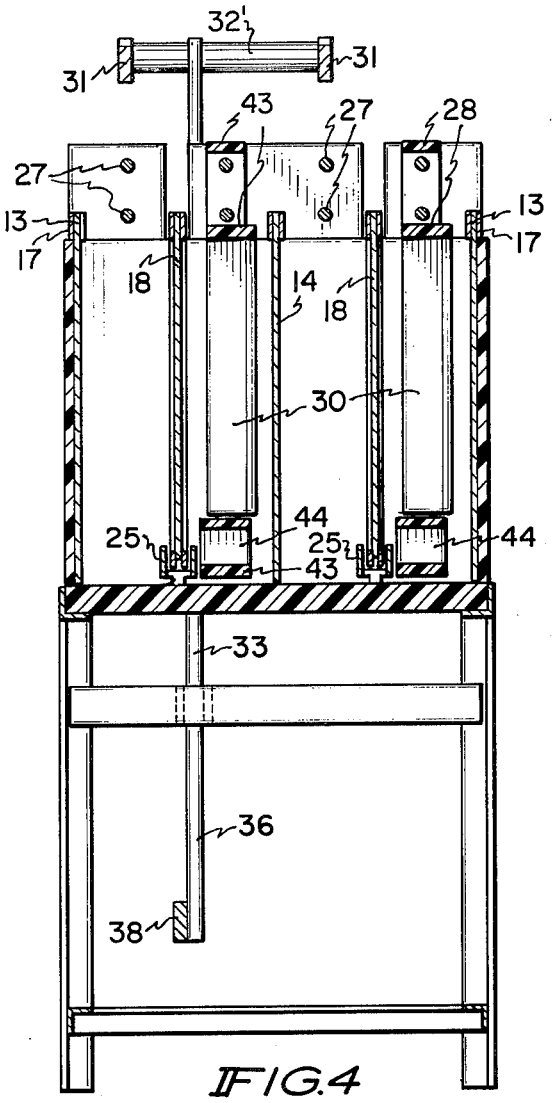

FIG. 4 is a sectional view taken in the plane of line 4—4 of FIG. 2 and looking in the direction of the arrows.

Figure 5:
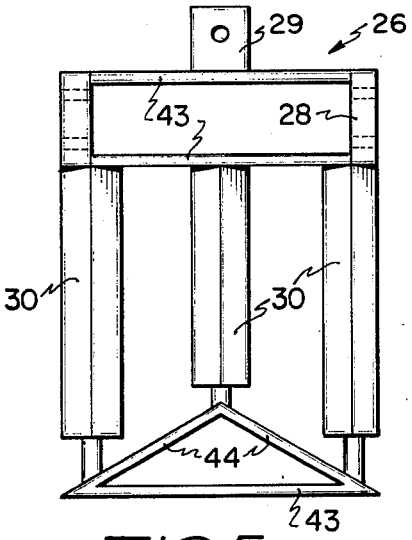

FIG. 5 is a side elevational view of the agitator employed in the cell illustrated in FIG. 1.

Figure 6:
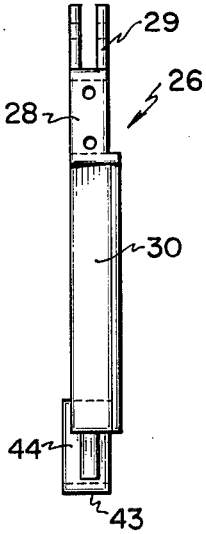

FIG. 6 is an end elevational view of the agitator assembly illustrated in FIG. 5.

Figure 7:
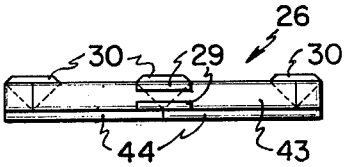

FIG. 7 is a top plan view of the agitator assembly illustrated in FIGS. 5 and 6.

Figure 8:
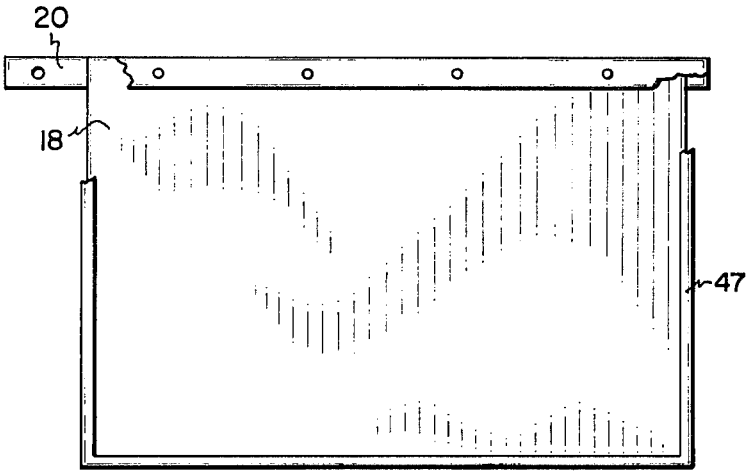

FIG. 8 is a side elevational view of a cathode plate adapted for use in the cell illustrated in FIG. 1.

Figure 9:
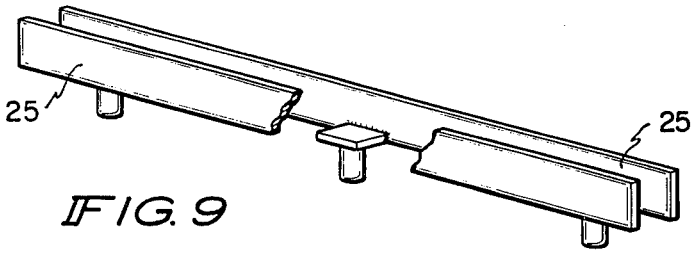

FIG. 9 is a perspective view of a bottom blanking fin assembly employed in the cell illustrated in FIG. 1, certain parts being broken away for clarity.

Figure 10:
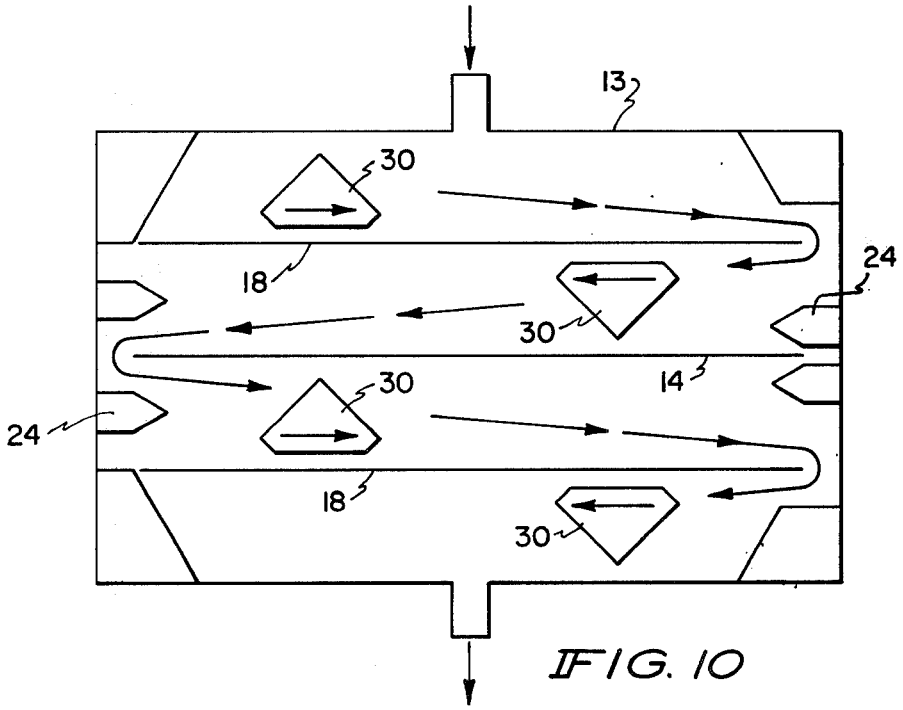

FIG. 10 is a top simplified schematic view illustrating flow in a cell embodying the present invention.

As illustrated, the cell comprises a rectangular tank 10 defined by opposite side walls 11 and end walls 12. The side walls 11 are lined with anode plates 13, typically lead antimony, but which may be of any suitable material. Dividing the tank lengthwise is another anode 14.

The center anode plate 14 is, as best shown in FIG. 2, supported by a horizontal bus bar 16 on which rest the long lugs 17 extending from the upper ends of the anodes thereof; and by notches in a plastic bar 15 in which are fitted the short lugs 17' at the opposite end of the anode.

The cell is further subdivided into a total of four compartments by fixed cathode plates 18 suitably supported by a bus bar 19 on which rest long lugs 20 extending from the top corner of each cathode plate and by notches in a plastic bar 15' which receives a short lug 20' at the opposite end of each cathode plate.

The anodes and cathodes are connected to suitable poles of a usual direct current source not shown.

Construction of the cathodes and anodes is not critical so long as provision is made to support them rigidly in the tank. In the illustrated embodiment (FIG. 8) the cathode plate 18 has a pair of reinforcing bars 20 along both sides at the top and the cathode is clamped therebetween by suitable bolts. To secure the cathode rigidly onto its bus bar 19, angle brackets are provided. The long ends of bars 20 are clamped onto these angles. For removal, the bolts are simply removed. The anode plates are, with minor modifications, similarly mounted.

All interior or intermediate electrodes are shorter than the tank thus terminate short of the tank ends to provide flow spaces around the electrodes which enable slurry to flow through the tank. The tank is provided with a suitable valved drain 21. As will be described in more detail hereinafter, liquid or slurry, as the case may be, is introduced into the tank via an inlet 22 and is eventually discharged through an outlet 23. Adjacent both ends of the tank and extending inwardly approximately one inch beyond the edges of both ends of each cathode is a series of non-conductive insulating strips 24 which actually are formed as a more or less continuous serrated edge along each end of the tank. Filets are provided adjacent the outer corners to avoid accumulation of solids. To enhance flow through the cell, a pressure drop is maintained between the inlet and outlet.

Spacing of the insulating strips 24 with respect to the ends of the electrodes is important to insure that the sharp cathode edges are protected against straight current flow from the nearest anode while at the same time insuring a relatively high velocity scrubbing action by directing slurry through a confined space past the edges of the cathodes.

The spacing is also selected to enhance flow between inlet and outlet when there is a continuous supply of slurry. This is accomplished by the arrangement as illustrated in FIGS. 2 and 10. In such arrangement the spacing adjacent the right end of the cathode nearest the inlet is relatively wide compared to that adjacent the other end of the same cathode. The wide and narrow spacings then alternate across the width of the cell. This defines a continuous but tortuous path through the successive wider spaces. In all cases, however, the insulating strips extend inwardly past the edges to overlap a part of the cathode edge.

The bottom edge of the cathode is blanked by means of flat nonconductive strips 25 mounted as an assembly (FIG. 9) to be in spaced overlapping relationship to the cathode bottom edge. These also confine and direct uprising slurry against the cathode.

Agitation and pumping of slurry is effected by a series of reciprocating agitators 26 one of which is provided for each compartment. Each agitator is supported on a pair of stainless steel rods 27 that run the length of the cell above each of the compartments. Each agitator is provided with two vertical hangers 28 each of which is bored to receive and slide on the rods. A center tow-member 29 on the top of each agitator connects to a rigid push-pull rod 31 which is in turn pivotally connected at a joint 32 to a lever 33 that extends down outside the tank to pivot at a fulcrum 34 whence it continues as a short lever 36 to a final pivot 37 which in turn connects to a bottom push-pull rod 38 connected onto a lug 39 on a wheel 41 secured to and driven by one end of the output shaft of a variable speed gear motor 42.

As best illustrated in FIG. 2, there is a lever assembly adjacent each end of the tank. Each assembly is driven by a separate wheel 41. Adjacent the top of each lever and transverse thereof is a horizontal member 32' which is arranged to drive a plurality of push-pull rods 31 and agitators 26 depending upon the size of the cell.

The agitator 26 itself comprises an open frame with vertical posts 30 depending from a transverse upper member. Horizontal reinforcing members 43 extend across both the top and bottom of the frame between the vertical posts. Two lower lift fins 44 extend inwardly and upwardly from the outer posts to join on the center post 30 above the bottom cross member. These fins are approximately two inches wide in a three inch wide cell and serve to keep the slurry in suspension as the agitator reciprocates. Their lower ends should be very close to the tank bottom, on the order of ¼ to ½ inch above it, to insure that all slurry is kept in suspension.

The cross sectional shape and location of the vertical agitator posts 30 are important. A desirable shape of the posts, in transverse cross section is, as illustrated in FIG. 2, that of a truncated diamond having an apex on one side and a flat base on the other but with angled surfaces connecting to the base for directing slurry. The posts are of sufficient size so that they come relatively close to both electrodes between which they are positioned. As the posts move, they cause a high velocity flow of displaced slurry between the post and electrode. This causes a unique but very effective scrubbing action on the electrode. The action is best described as a moving line scrubbing action because it is at its maximum between the post and plate.

Depending upon the material being treated, the agitator parts may be centered in the cell or offset to one side of the cell for the purpose of directing flow preferentially to one or the other of the electrodes. As best seen from the schematic illustration of FIG. 6, the center line of the agitator or flow proportioner post 30 is displaced from the center lines of the rods 27 and support hangers 28. Thus, simply by reversing the agitator elements on the rods 27, the flow pattern can be reversed and more slurry directed to an electrode of opposite polarity.

In the embodiment illustrated, the posts 30 are arranged closer to the cathode than to the anode and the apex of the diamond is toward the anode. The result is that there is approximately twice as much slurry directed against the anode as against the cathode. The effect is to favor ferric leaching, ferric regeneration and other anodic reactions that assist in leaching of metals from metal sulfide particles at a rate at least equal to the rate of metal deposition on the cathode. In other words, we provide ways and means whereby the leaching rate is maintained at least as high as the plating rate so that no makeup solution is required. This increases the anode efficiency and makes it possible to operate the cell with efficient results at an anode to cathode area ratio of about 1 to 1. This agitator arrangement is especially useful when copper sulfide slurries and/or concentrates are being treated in the presence of high iron concentrations (above 15 gpl) and high current densities because the chemical reactions involved in electrowinning of copper sulfides under such conditions require a high anode participation. This high participation can be achieved by excess anode area or increasing anode efficiency. We have discovered that anode efficiency can be increased by the step of directing a sufficient supply to the anode surface to take advantage of conditions there to regenerate the ferric iron as needed for ferric leaching in accordance with the equations:

$$Cu_2S + 2Fe^{+++} - - - CuS + 2FE^{++} + Cu^{++} \text{and}$$
$$CuS + 2Fe^{+++} - - - Cu^{++} + 2F^{++} + S$$

The invention provides ways and means to take advantage of this discovery, including a cell adapted to effect flow control necessary to maximize utilization of electrodes.

When oxide ores are being treated, it is necessary to inhibit anode oxidizing reaction because ferric iron is undesirable. To achieve this, the position of the vertical agitator posts may simply be reversed so that a greater flow of slurry is pushed against the cathode which favors the formation of ferrous iron. In other words, anodic reaction is minimized to avoid generation of excess ferric iron which might attack product copper on the cathode. In other cases, such as where the ore is a mixture of oxide and sulfides, it may be necessary to have equal slurry flow against each electrode to achieve the necessary balance in the cell.

Although the ratio of flow against the anode and cathode respectively may vary from case to case, it may be determined empirically and the cell set up to operate under the necessary flow conditions.

Although not shown in connection with the illustrated embodiment, it is within the ambit of this invention to provide an agitator in which the flow control is infinitely variable rather than stagewise as shown. In such a structure, mechanical means may be provided to vary the slope of deflection plates or their mounting on the drive means. Such devices are not the exact equivalent of the illustrated embodiment, but are useful under different conditions.

For ease of illustration, the cell is shown as having only four compartments. In actual practice it may have any desired number.

The cell is particularly designed and adapted for use in the direct electrowinning of metals from slurries of metal concentrates or ores. It is also useful in the electrorefining or winning of metals from clear solutions.

To minimize dendritic buildup and avoid metal deposit over the cathode edge, a thin coating 47 of nonconductive plastic material to which solids do not cling is applied over the cathode edges. This, along with the blanking fins 24, protects the cathode against formation of undesirable dendritic deposits adjacent the edges.

Product is harvested by removing the cathode and stripping sheets therefrom.

In operation, the cell will be set up substantially as shown in the drawings. In a continuous flow-through operation, fresh slurry is admitted through the inlet and spent slurry discharged from the outlet while the cell operates at current densities of up to 100 or more amps/ft$^2$ of cathode area and at a linear travel of the agitator in the range of from 50 to 70 ft. per min. depending on the ore being treated. A usual range suitable for most slurries is 65–85 ft. per min. because this will achieve the desired agitation while minimizing splash and electrolyte loss.

Suitable cathode material is titanium; and the anode may be the usual lead-antimony plate containing 8–9% of antimony. Obviously, the electrodes may be selected to accommodate the metals sought.

Other materials of construction will be selected as needed. The main consideration is that the circuit be properly designed to avoid short circuits. In our work, we have relied heavily on plastic such as polypropylene because it can be molded and has insulating properties.

The cell may be operated for batch runs, as described below.

A prototype cell was constructed using a basic rectangular tank formed from polypropylene. The tank was 20 inches deep, 21 inches wide and 34 inches long. The agitator assemblies were 18 inches high by 15 inches wide. Each agitator post was 1⅜ inches wide (apex to base) by 3 inches long. Each of the intermediate electrodes was 32½ inches long by 21½ inches high with approximately 15 inches submerged. The anodes were ⅜ inch thick and the cathodes were ⅛ inch thick. The cathode edges were covered with plastic approximately ¼ inch thick and covered the edges inch.

One pair of opposite walls of the tank were lined with a lead antimony anode material. The tank was divided into eight compartments by titanium cathodes and additional anodes constructed as described. The blanking fins and agitators were as illustrated.

With the agitators positioned as illustrated, the space between the apex and the anode was ¾ inches and between the flat side of the post and the cathode was ⅜ inches. As noted, this results in twice as much flow toward the anode hence favors the anodic reaction and thus enhances recovery of copper from sulfide ores in which relatively high soluble iron is used. The cell was operated in this configuration starting with electrolyte containing 30 gpl copper as $CuSO_4$, 32 gpl ferrous iron and 130 gpl of $H_2SO_4$. A chalcocite concentrate of 90% minus 325 Tyler mesh, in which 90–95% of the copper content was as chalcocite and 5–10% as chalcopyrite was treated by periodic additions thereof to the cell. Two six-hour tests were conducted under the following conditions and results. During each test, fresh concentrate was added at one-half hour intervals through the first four and one-half hours. Operation was on a batch rather than continuous basis.

| Run | Current Density Amps/ft$^2$ | Current Efficiency % | Power KwH/LB Copper | Recovery from ore % |
|---|---|---|---|---|
| 1 | 73.5 | 73.3 | 1.69 | 94.2 |
| 2 | 70.8 | 75.7 | 1.66 | 94.2 |
| Average | | | | 94.2 |

The agitators were reversed to favor flow to the cathode but all other conditions remained the same. Results were as follows:

| Run | Current Density Amps/ft$^2$ | Current Efficiency % | Power KwH/LB Copper | Recovery from ore % |
|---|---|---|---|---|
| 1 | 73.4 | 74 | 1.69 | 90.9 |
| 2 | 73.1 | 74.1 | 1.68 | 87.2 |
| 3 | 72.8 | 75 | 1.66 | 88 |
| Average | | | | 88.7 |

In the runs, power was maintained at 3.25 volts. Current efficiency is calculated on reduction of copper from cupric state.

The significant change is in the percent recover. When the agitators are in position to provide proportionately increased flow toward the anode to take advantage of conditions there that favor recovery from sulfide, then the average percent recovery increased almost 6%, from 88.7% to 94.2%. This dramatic increase clearly demonstrates the influence of flow proportioning on the process and the ability of the cell to achieve such proportioning. When treating oxide ores, or in other operations where high iron concentrations are not present, or where, for other reasons, anodic reactions are not desirable, the agitator would be positioned to reduce flow against the anode. Obviously, the quantities diverted towards each electrode can be precisely set to current needs by periodic determination and adjustment.

We claim:

1. An electrolytic cell comprising a tank, at least one anode plate and one cathode plate suspended in said tank in spaced parallel relationship to each other defining a compartment therebetween, an agitator assembly in said compartment between said anode and cathode plates comprising at least one shaped member, rigid means mounting said agitator for reciprocating movement in a fixed path between said plates and means included in said agitator assembly for continuously directing a preselected volume of tank contents toward each of said plates upon reciprocation of said agitator assembly in said compartment.

2. An electrolytic cell according to claim 1 with the addition of strips of non-conductive material mounted in said tank spaced from the bottom and end edges of said cathode plate and between said edges and said anode plate.

3. An electrolytic cell according to claim 1 in which the side and bottom edges of said each cathode plates are coated with a nonconductive material.

4. An electrolytic cell according to claim 2 in which at least one anode plate and one cathode plate are suspended inside the tank and are of size to have their ends terminate short of the tank end walls, said non-conducting strips adjacent an end edge of each of said cathodes comprise strips of material secured to and extending inwardly from the tank wall in the form of a "V" formed between adjacent strips with the end edges of said cathodes and anodes extending into the mouth of said "V" whereby a passage is defined around the ends of said plates.

5. An electrolytic cell according to claim 2 in which alternating anode plates and cathode plates define a plurality of adjacent compartments.

6. An electrolytic cell according to claim 5 in which the tank is provided with an inlet and an outlet on opposite sides thereof, the spaces around the ends of said electrode plates form a tortuous path between said inlet and said outlet, and said non-conducting strips adjacent the end edges of the cathodes are arranged so that the space between one end of a plate and the non-conducting strip is greater than the space between the opposite end of said plate and the non-conductive strip on the same side of said plate.

7. An electrolytic cell according to claim 1 in which said agitator assembly includes at least one substantially vertical post shaped in transverse cross section as a diamond truncated on one side, thereby to have an apex and a base, said means mounting said assembly for reciprocation includes means enabling selectively positioning said apex of said post adjacent a selected one of said electrode plates at a greater distance therefrom than said base is from the other of said adjacent electrode plates, there is provided on said assembly an upwardly sloped agitator strip; and said agitator strip is substantially centered in the compartment between adjacent electrode plates.

8. The electrolytic cell according to claim 7 in which said tank is rectangular and the outermost ones of said electrode plates from the inner surfaces of one pair of opposite side walls of said tank.

9. An electrolytic cell according to claim 1 in which said electrodes define a plurality of adjacent compartments, an agitator assembly is provided for each of said compartments and said means for effecting said reciprocating movement includes means for effecting opposing motion of said assembly in adjacent compartments.

* * * * *